US008142058B2

(12) United States Patent
Yang

(10) Patent No.: US 8,142,058 B2
(45) Date of Patent: Mar. 27, 2012

(54) TRI-DIMMING PUSH HANDLE SWITCH LAMPHOLDER

(75) Inventor: Wen-Ho Yang, Taipei County (TW)

(73) Assignee: Goldweal Far East Ltd., Dongguan (CN)

( * ) Notice: Subject to any disclaimer, the term of this patent is extended or adjusted under 35 U.S.C. 154(b) by 402 days.

(21) Appl. No.: 12/588,556

(22) Filed: Oct. 20, 2009

(65) Prior Publication Data

US 2011/0089870 A1 Apr. 21, 2011

(51) Int. Cl.
*H01R 33/22* (2006.01)

(52) U.S. Cl. ..... 362/441; 362/435; 439/414; 439/417; 315/362

(58) Field of Classification Search ..... 315/362; 362/441, 435, 448, 655, 649, 652, 404; 439/414, 439/417, 409, 410, 236, 227, 542, 543, 658, 439/644, 642

See application file for complete search history.

(56) References Cited

U.S. PATENT DOCUMENTS 4,285,033 A * 8/1981 Hart ..... 362/295
5,514,006 A * 5/1996 Getselis et al. ..... 439/417
5,873,748 A * 2/1999 Getselis et al. ..... 439/414

* cited by examiner

*Primary Examiner* — Vibol Tan
(74) *Attorney, Agent, or Firm* — Bacon & Thomas, PLLC

(57) ABSTRACT

A tri-dimming push handle switch lamp holder is disclosed, which enables a user to press the push handle for a selection among three dimming levels: full brightness, middle luminance and complete darkness, where the lamp holder is made up of a body, a first conducting member, a first contact plate, a conducting plate, a second conducting member, a second contact plate, a rectifying diode, a flap, a push handle, an insulating plate and a threaded tube shell, which are integrated together to form an advanced lamp holder that features not only the basic switching function but an extra tri-level dimming function, substantially boosting its usage for all kinds of occasions. Moreover, an extra arrangement of the conducting plate and the rectifying diode enables the structural combination and the function of this invention to present great creativeness.

3 Claims, 6 Drawing Sheets

TRI-DIMMING PUSH HANDLE SWITCH LAMPHOLDER

BACKGROUND OF THE INVENTION

1. Field of the Invention

This invention relates generally to a push handle switch lamp holder and more specifically to one that enables a user to press the push handle for a selection among three dimming levels: full brightness, middle luminance and complete darkness.

2. Description of the Prior Art

A practical electric lamp is developed by Thomas Edison in 1879, which has been the electric lighting that is indispensable to mankind. A light bulb to be used is mounted on a lamp holder, where the lamp holder is for the support of the light bulb and the supply of electric power, and that means the lamp holder is a vital object that integrates the light bulb into an integral whole. Prior lamp holders are categorized into four kinds: switch-free lamp holder (switch is connected to the power cord), knob switch lamp holder, pull chain switch lamp holder and push handle switch lamp holder, subject to the way of handling the switch. As for the prior popular push handle switch lamp holders, the push handle is pressed to move, which leads to two actions: one for conduction (ON) and the other for cutoff (OFF) with respect to the current flow of the light bulb. It also means that the prior push handle switch lamp holders feature only two dimming levels—ON and OFF, which fails to adjust the luminance of the light bulb for the pressing of the push handle. This dull function is always inefficient in some circumstances. Common examples for these circumstances are as follows: the lamp for a dining table sometimes demands full brightness (for instance: gatherings for the elders or the children), occasions that demand half-bright luminance (for instance: date for lover, time close to midnight, or others that full brightness is inappropriate). A desk lamp most of the times need full brightness (for instance: reading as someone seated himself/herself in a chair). Other occasions demand half-bright luminance (for instance: the moment in the late night before sleeping). However, as far as the conventional push handle switch lamp holders are concerned, they completely fail to conform to the aforementioned requirements. Therefore, how to provide a tri-dimming push handle switch lamp holder that features a selection among three dimming levels: full brightness, middle luminance and complete darkness to meet the aforementioned requirements and to achieve handiness for the operation are the ideas of this invention.

SUMMARY OF THE INVENTION

In the light of the aforesaid demands, this inventor conceived the idea through research and development, and eventually the longtime endeavors gave birth to this invention.

The objective of this invention is to provide a tri-dimming push handle switch lamp holder that enables a user to press the push handle for a selection among three dimming levels: full bright, middle luminance and complete darkness.

To achieve the aforementioned objects, the tri-dimming push handle switch lamp holder of this invention, comprising: a body, having a through hole penetrating from top to bottom and a lodging trough set up horizontally around the center therein, where the lodging trough is provided with a first open trough and a second open trough at its both sides respectively, and the first open trough and the second open trough each is connected inward to an electric cord joint on the body; a first conducting member, L in shape, having a conducting loop at its one end, and a clip head at the other end, lodged in the first open trough, where the clip head is close to the electric cord joint in the body and the conducting loop is positioned at a place higher than the body; a first contact plate, formed by bending a conductive plate, is lodged in the first open trough and is insulated separately from the first conducting member, and the one end corresponding to the lodging trough forms a position indent, which is lodged in the lodging trough and attached to the inner wall of the lodging trough; a second conducting member, L in shape, having a clip head at its one end, lodged in the second open trough, where the clip head is placed close to the electric cord joint in the body; a second contact plate, formed by bending a conductive plate, is lodged in the second open trough and is connected to the second conducting member, and the one end corresponding to the lodging trough forms a position indent, which is lodged in the lodging trough and attached to the inner wall of the lodging trough; a flap, having a contact point at its one end, and is connected to the first contact plate at the other end; a push handle, bar in shape, having a conducting member transversely disposed at its center and lodged in the lodging trough, and is available to be pressed that the conducting member either touches on or removes from the position indent of the first contact plate and the second contact plate; an insulating plate, covered on the body, having a hollow corresponding to the through hole and having a bore, where the conducting loop of the first conducting member corresponds with a hollow as it penetrates from the insulating plate; the bore is penetrated by the contact point portion of the flap; and a threaded tube shell, made of a conductive plate and hollow cylinder in shape, and threads are formed on its inner wall, for threaded connection with the threaded head of a light bulb, and the side joining the insulating plate has an opening, for the accommodation of the contact point portion of the flap, and is provided with hollows corresponding to the hollows at the insulating plate at the rest area other than the opening, for the penetration of corresponding hollows and the through holes by fasteners, to combine the threaded tube shell, the insulating plate and the body together;

featuring: a first indent wall and a second indent wall are formed on both sides of the lodging trough of the body respectively, and each wall is made of three wavelike indents, where the first indent wall forms an insulating section at its middle wavelike indent, and the wall in between the first open trough and the first indent wall is provided with a first holding trough and a second holding trough, while the wall in between the second open trough and the second indent wall is provided with a third holding trough, and a lodging pit is set up at the side of the first open trough; the first contact plate is plugged in the first holding trough for a clipping, and the position indent corresponding to the side of the lodging trough is lodged in the lodging trough and attached to the wavelike indent next to the first indent wall; a conducting plate, formed by bending a conductive plate, is lodged in the first open trough and is plugged in the second holding trough for a clipping, and a position indent is formed at the side corresponding to the first indent wall, is lodged in the lodging trough and attached to the wavelike indent next to the first indent wall; the second contact plate is plugged in the third holding trough for a clipping, and the position indent corresponding to the side of the lodging trough is made of three wavelike indents and is attached to the three wavelike indents of the second indent wall; a rectified diode, lodged in the lodging pit, where its positive pole is connected to the contacting plate and its negative pole to the first contact plate; the push handle has a through hole transversely disposed at its center, for the accommodation of a springy member, where its two sides each joins an arc-shaped conducting member, and the conducting member tends to move outward by means of the elasticity of the springy member, where the conducting member at one side touches one of the three indents of the position indent of the second contact plate, and the conducting member at the other side touches the position indent of the first contact plate, the insulating section and one of the three indents of the position indent of the conducting plate.

In the aforementioned tri-dimming push handle switch lamp holder, where the first conducting member is lodged in the first open trough, followed by placing an insulating chunk in the first open trough for the covering of the first conducting member, and placing the first contact plate in the first open trough, for insulating separately the first conducting member from the first contact plate through the use of the insulating chunk.

In the aforementioned tri-dimming push handle switch lamp holder, where the body is formed into a set of cord frames at its top, each has a holding trough, for the clipping of the two wires of the power cord in the holding trough for a firm joining.

DETAILED DESCRIPTION OF THE INVENTION

To achieve the aforesaid objectives of the present invention, the technique adopted and the function achieved are detailed described with reference to the following preferred embodiments and the accompanying drawings, which would give a thorough comprehension on the present invention.

Figure 1:
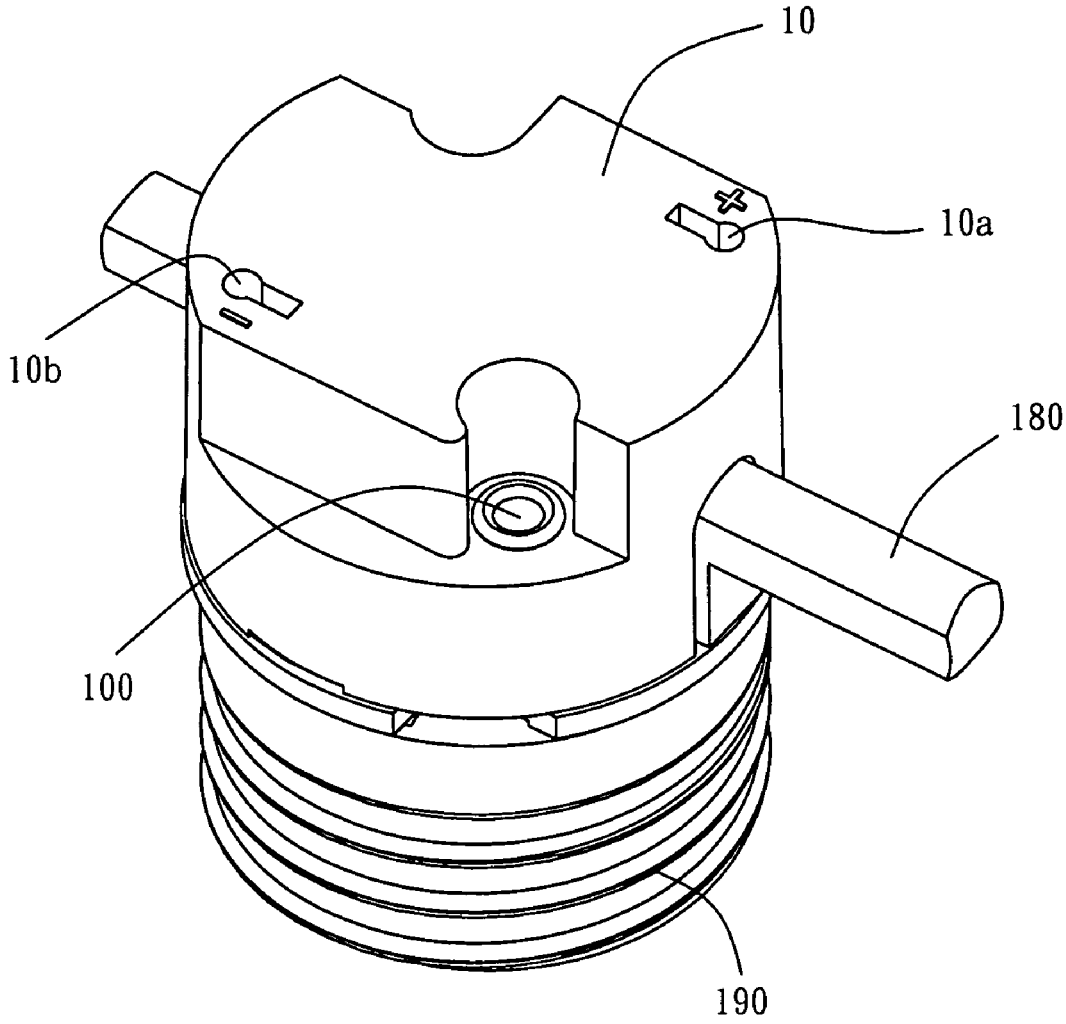
FIG. 1 is a three-dimensional view of the appearance of the combination of the exemplary embodiment of this invention.
Figure 2:
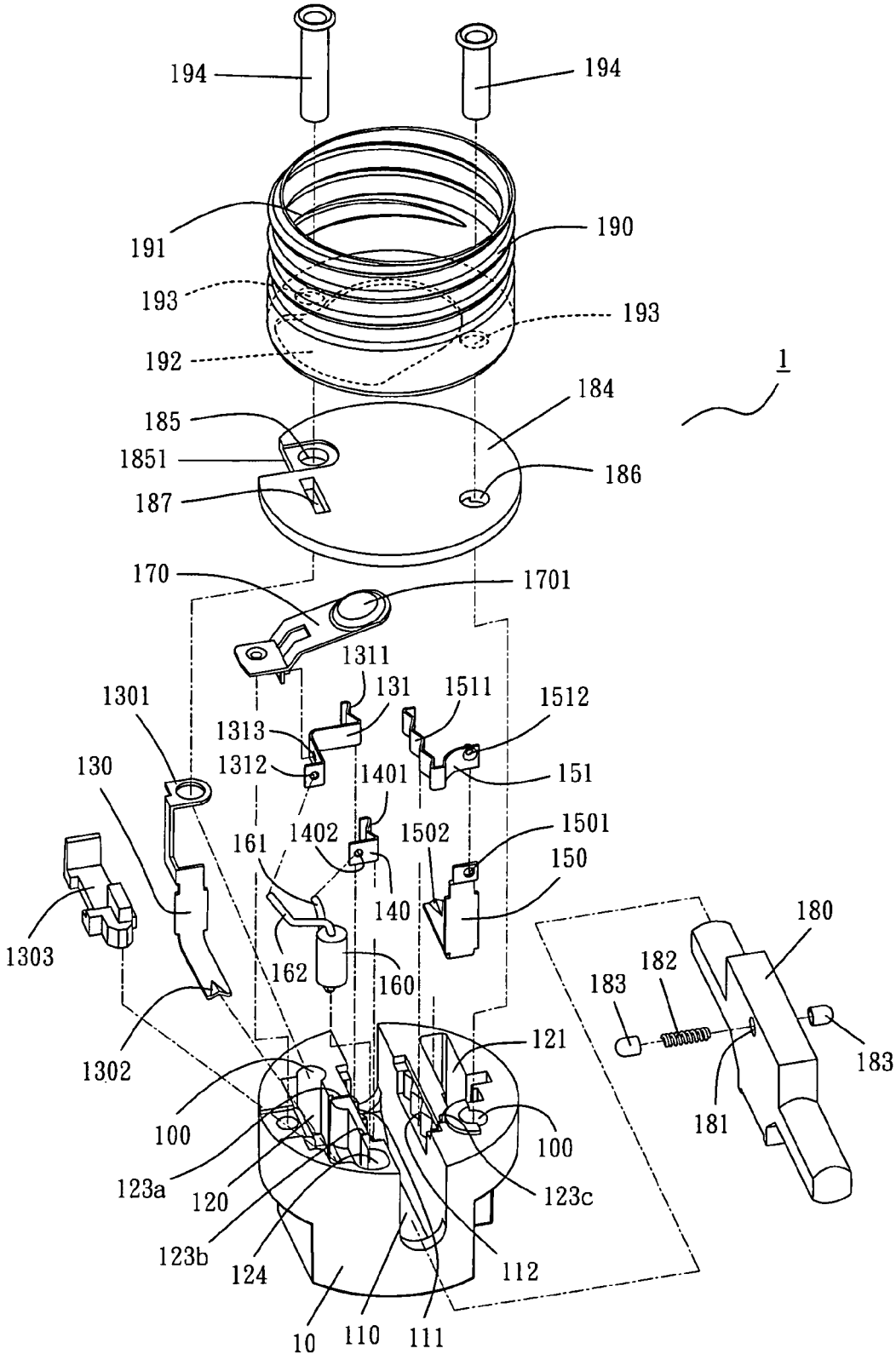
FIG. 2 is a three-dimensional exploded view of the exemplary embodiment of this invention.
Figure 3:
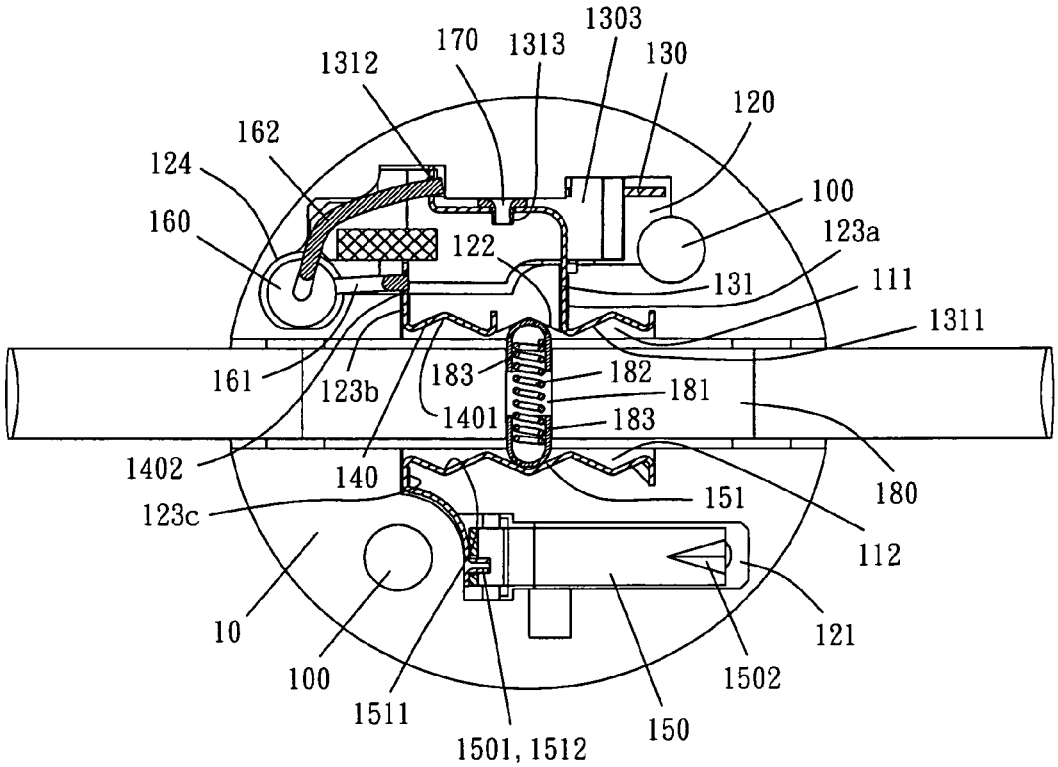
FIG. 3 is a schematic diagram (I) of the use and combination of the exemplary embodiment of this invention.

Referring to FIGS. 1~3, the first exemplary embodiment of this invention is a push handle switch lamp holder 1, comprising:

a body 10, having a through hole 100 penetrating from top to bottom at each of its two sides and a lodging trough 110 set up horizontally around its center, where the lodging trough 110 is provided with a first indent wall 111 and a second indent wall 112 on its two inner walls respectively, each has three wavelike indents wall, and the middle wavelike indent of the first indent wall 111 forms an insulating section 122 (detail description later on). The body 10 is provided with a first open trough 120 and a second open trough 121 at the back of the first indent wall 111 and the second indent wall 112, which are located at both sides of the lodging trough 110. The wall located in between the first open trough 120 and the first indent wall 111 is provided with a first holding trough 123*a* and a second holding trough 123*b*, while the wall located in between the second open trough 121 and the second indent wall 112 is provided with a third holding trough 123*c*, and all are thin in shape. The first open trough 120 is provided with a lodging pit 124 at its side. And the first open trough 120 and the second open trough 121 extend inward to join cord holes 10*a*, 10*b* (shown in FIG. 1) respectively on the body 10;

a first conducting member 130, L in shape, having a conducting loop 1301 at the top end, and a clip head 1302 at the other end. During the assembly, the first conducting member 130 is lodged in the first open trough 120, where the clip head 1302 is placed close to the cord hole 10*b* in the body and the conducting loop 1301 is positioned at a place higher than the body 10, followed by placing an insulating chunk 1303 in the first open trough 120 to shield off the first conducting member 130;

a first contact plate 131, formed by having a conductive plate bent three times, where the one end corresponding to the first indent wall 111 forms a wavelike position indent 1311, and the other end forms a joint hole 1312, and the middle of the plate forms another joint hole 1313. During the assembly, the first contact plate 131 is lodged in the first holding trough 123*a* for a clipping, and the position indent 1311 is lodged in the lodging trough 110 and closely attached to the wavelike indent at one side to the first indent wall 111, where the plate with joint holes 1312, 1313 is drawn to enter the first open trough 120 and insulated separately from the first conducting member 130 by the insulating chunk 1303;

a conducting plate 140, formed by having a conductive plate bent, where the one end corresponding to the first indent wall 111 forms a wavelike position indent 1401, and the other end forms a joint hole 14022. During the assembly, the conducting plate 140 is lodged in the second holding trough 123*b* for a clipping, and the position indent 1401 is lodged in the lodging trough 110 and closely attached to the wavelike indent at the other side to the first indent wall 111, where the plate with joint holes 1402 is drawn to enter the first open trough 120. To this point, one side indent of the three wavelike indents of the first indent wall 111 is attached by the position indent 1311 of the first contact plate 131, while the other side indent is attached by the position indent 1401 of the conducting plate 140, and only the middle indent of the three wavelike indents of the first indent wall 111 is left without being attached to. Since the middle indent is not made of electrically conductive material, it forms an insulating section (mentioned in the front);

a second conducting member 150, L in shape, having a joint hole 1501 at its top end and a clip head 1502 at the other end. During the assembly, the second conducting member 150 is lodged in the second open trough 121, where the clip head 1502 is placed close to the cord hole 10*a* in the body 10, and the joint hole 1501 is placed at a place that is relatively top (the direction shown in FIG. 2); a second contact plate 151, formed by bending a conductive plate, where the one end corresponding to the second indent wall 112 forms a three wavelike indents position indent 1511, the other end forms a joint hole 1512. During the assembly, the second contact plate 151 is lodged in the third holding trough 123*c* for a clipping, and the three wavelike indents position indent 1511 is lodged in the lodging trough 110 and closely attached to the wall of the three wavelike indents of the second indent wall 112, where the plate with joint hole 1512 is drawn to enter the second open trough 121, and joins the joint hole 1501 of the second conducting member 150;

a rectifying diode 160, an electric component having unidirectional conductivity (positive direction is for conduction while negative is for cutoff), is lodged in the lodging pit 124, where its positive pole 161 is connected to the joint hole 1402 of the conducting plate 140, while its negative pole 162 to the joint hole 1312 of the first contact plate 131, which enables the conducting plate 140 to be positive relatively to the first contact plate 131 which enables the conduction of electricity, while the first contact plate 131 is negative relatively to the conducting plate 140 which leads to a cutoff;

a flap 170, having a contact point 1701 at its lifted end, and is connected to the joint hole 1313 of the first contact plate 131 at the lower end;

a push handle 180, bar in shape and longer than the lodging trough 110, having a through hole 181 transversely disposed at its center, for the accommodation of a springy member 182, where each of both sides of the springy member 182 joins a arc-shaped conducting member 183, and the conducting member 183 tends to move outward by means of the elasticity of the springy member 182. During the assembly, the push handle 180 is lodged in the lodging trough 110, where the conducting member 183 at one side touches one of the three indents of the position indent 1511, and the conducting member 183 at the other side touches the position indent 1311, the insulating section 122 and one of the three indents of the position indent 1401, its function will be described later;

an insulating plate 184, roughly a disc covering the body 10, and the disc is provided with a first hollow 185 and a second hollow 186, corresponding to the through holes 100 respectively, where the first hollow 185 sinks at its surrounding and has a chip 1851, for the penetration by the conducting loop 1301 of the first conducting member 130, where the conducting loop 1301 is a perfect fit to fill the chip 1851 and to aim at the first hollow 185. A rectangular bore 187 is set up at the vicinity of the first hollow 185, for the penetration by the contact point 1701 portion of the flap 170, where the portion is then placed at the top of the center of the insulating plate 184;

a threaded tube shell 190, made of a conductive plate and hollow cylinder in shape, and threads 191 are formed on its inner wall, for the threaded connection with the threaded head of a light bulb. And the side joining the insulating plate 184 has an opening 192, for the accommodation of the contact point 1701 portion of the flap 170, and is provided with hollows 193 at the rest area other than the opening corresponding to the first hollow 185 and the second hollow 186. During the assembly, a set (two pieces) of fasteners 194 (for instance: rivet) are used to penetrate through the hollows 193, the first hollow 185, the second hollow 186 and the through hole 100 respectively, to mount the three: the threaded tube shell 190, the insulating plate 184 and the body 10 together.

As the assembly of the aforementioned parts is accomplished, the look of the whole push handle switch lamp holder 1 is shown in FIG. 1, where this whole piece is further covered by an insulated outer shell (not shown in the figures), to enhance beauty and to avoid an electric shock due to the exposure of the threaded tube shell 190. When making use of it, the power cord is connected through the outer shell, and the naked terminals of its two wires are inserted in the cord holes 10*a*, 10*b*, to join the first conducting member 130 and the second conducting member 150 respectively for a clipping firmly. The alternating current from its power source at this moment is connected to the first conducting member 130 and the second conducting member 150, where the alternating current flows through the conducting loop 1301 of the first conducting member 130 and the fastener 194 to the threaded tube shell 190. And the second conducting member 150 will conduct the electricity to the second contact plate 151. A user is then ready to have the threaded head of a light bulb in threaded connection with the inner threads 191 of the threaded tube shell 190, for the contact of the apex of the threaded head with the flap 170. And the user is then ready to press the push handle 180 for a selection among three dimming levels: full brightness, middle luminance and complete darkness.

Figure 4:
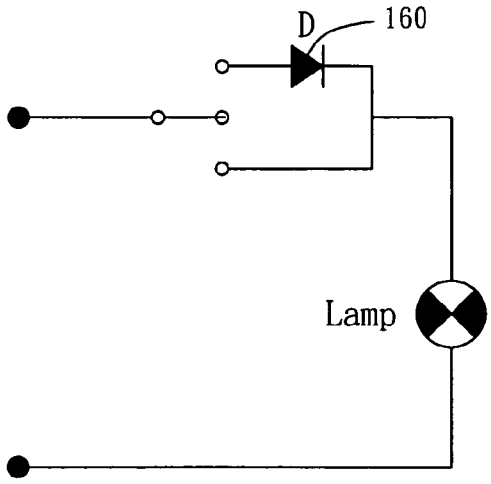
FIG. 4 is a schematic diagram of the circuit corresponding to FIG. 3.
Figure 5:
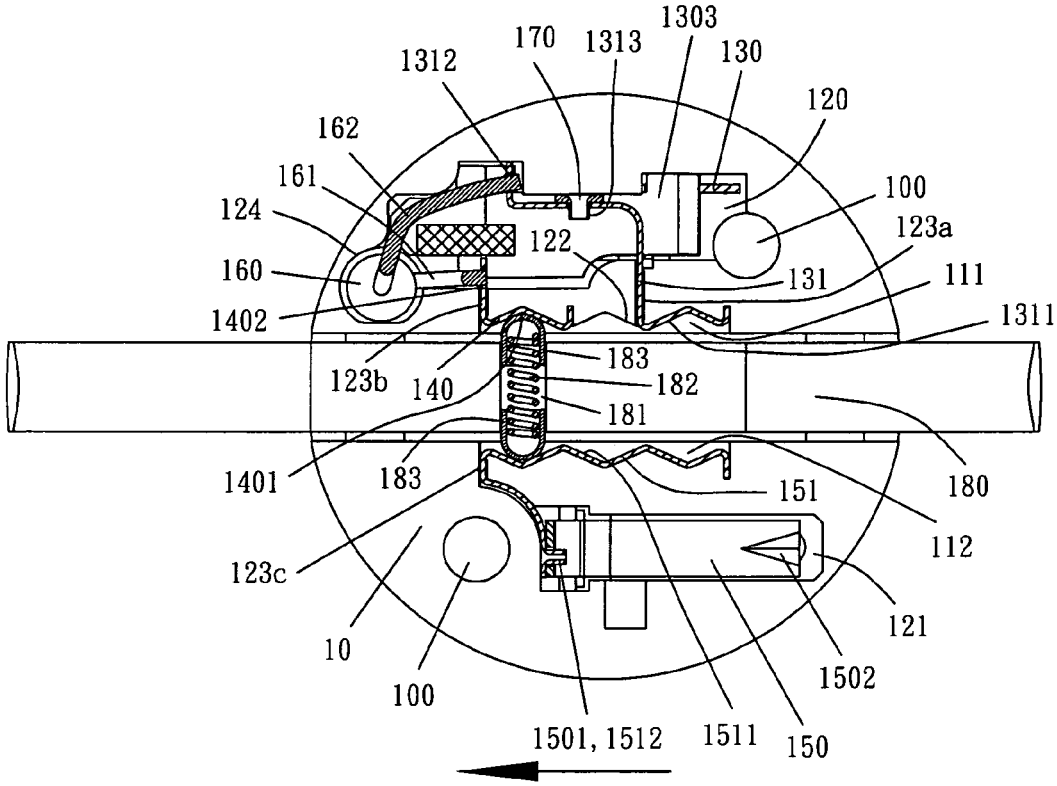
FIG. 5 is a schematic diagram (II) of the use of the exemplary embodiment of this invention.
Figure 6:
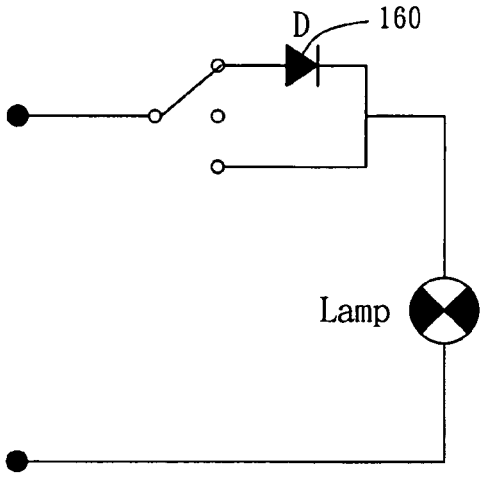
FIG. 6 is a schematic diagram of the circuit corresponding to FIG. 5.

Referring to FIG. 3, as a user presses the push handle 180 to move the conducting member 183 at one side in the boundary of the insulating section 122, the conducting member 183 at the other side moves into the middle indent (that is the push handle is pressed to the middle position) of the position indent 1511. At this moment, the insulating section 122 is unable to conduct electricity. The electric current flows through the position indent 1511 to the conducting member 183, but it is then blocked by the insulating section 122 and fails to reach the flap 170. The light bulb is therefore in complete darkness, and this state is shown in FIG. 4. Referring to FIG. 5, as a user presses the push handle 180 toward one side of the body, which moves the conducting member 183 at one side in the boundary of the position indent 1401 of the conducting plate 140, the conducting member 183 at the other side moves into the other indent of the position indent 1511, and then the electric current flows through the following route: the position indent 1511, the conducting member 183, the conducting plate 140, the positive pole 160, the rectifying diode 160, the negative pole 162, the first contact plate 131, the flap 170, and through the apex of the light bulb into the light bulb to form a closed loop. Since the current flows through a rectifying diode 160, it is a unidirectional conduction. And the load is in half conduction; therefore, the light bulb is in middle luminance, where its circuit is shown in FIG. 6.

Figure 7:
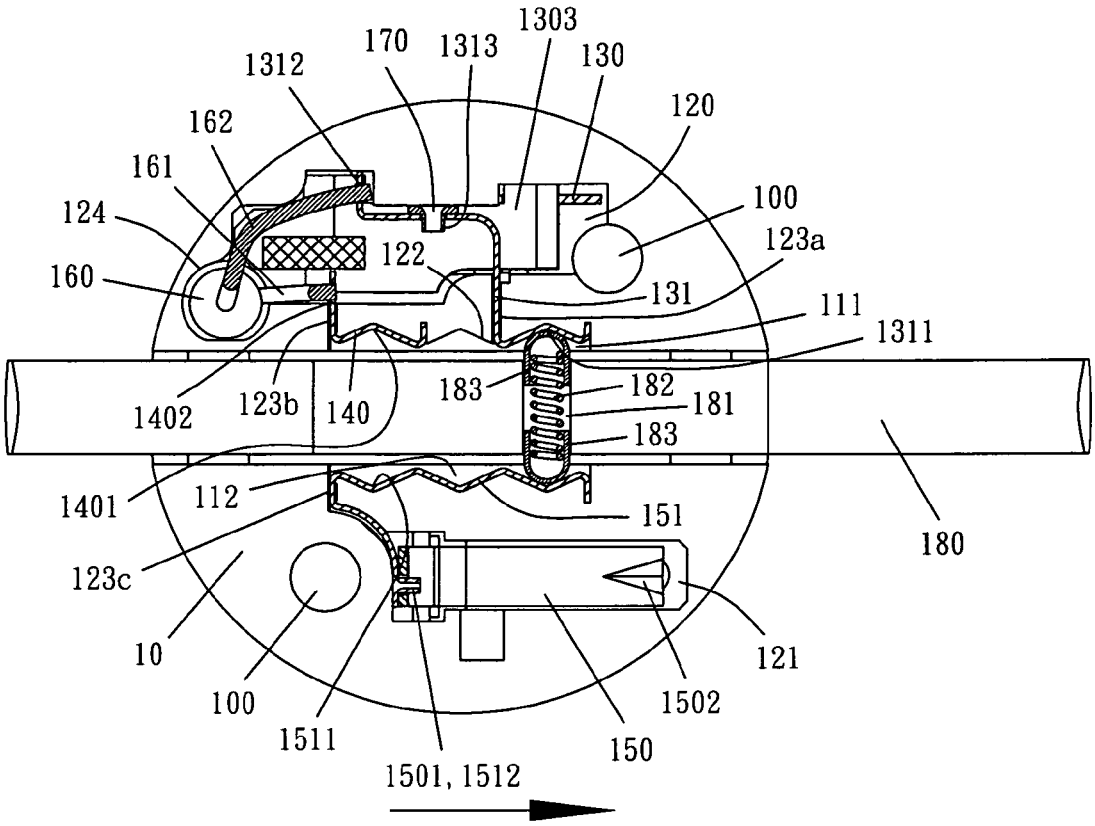
FIG. 7 is a schematic diagram (III) of the use of the exemplary embodiment of this invention.
Figure 8:
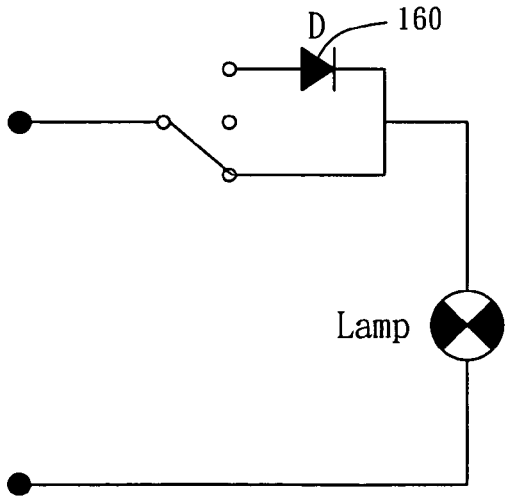
FIG. 8 is a schematic diagram of the circuit corresponding to FIG. 7.

Referring to FIG. 7, as a user presses the push handle 180 toward the other side of the body, which moves the conducting member 183 at one side within the boundary of the position indent 1311 of the first contact plate 131, the conducting member 183 at the other side moves into the third indent of the position indent 1511, and then the electric current flows through the following route: the position indent 1511, the conducting member 183, the first contact plate 131, the flap 170, and through the apex of the light bulb into the light bulb to form a closed loop. Since the current does not flow through the rectifying diode 160, the load is in full conduction; therefore, the light bulb is in full brightness, where its circuit is shown in FIG. 8.

Figure 9:
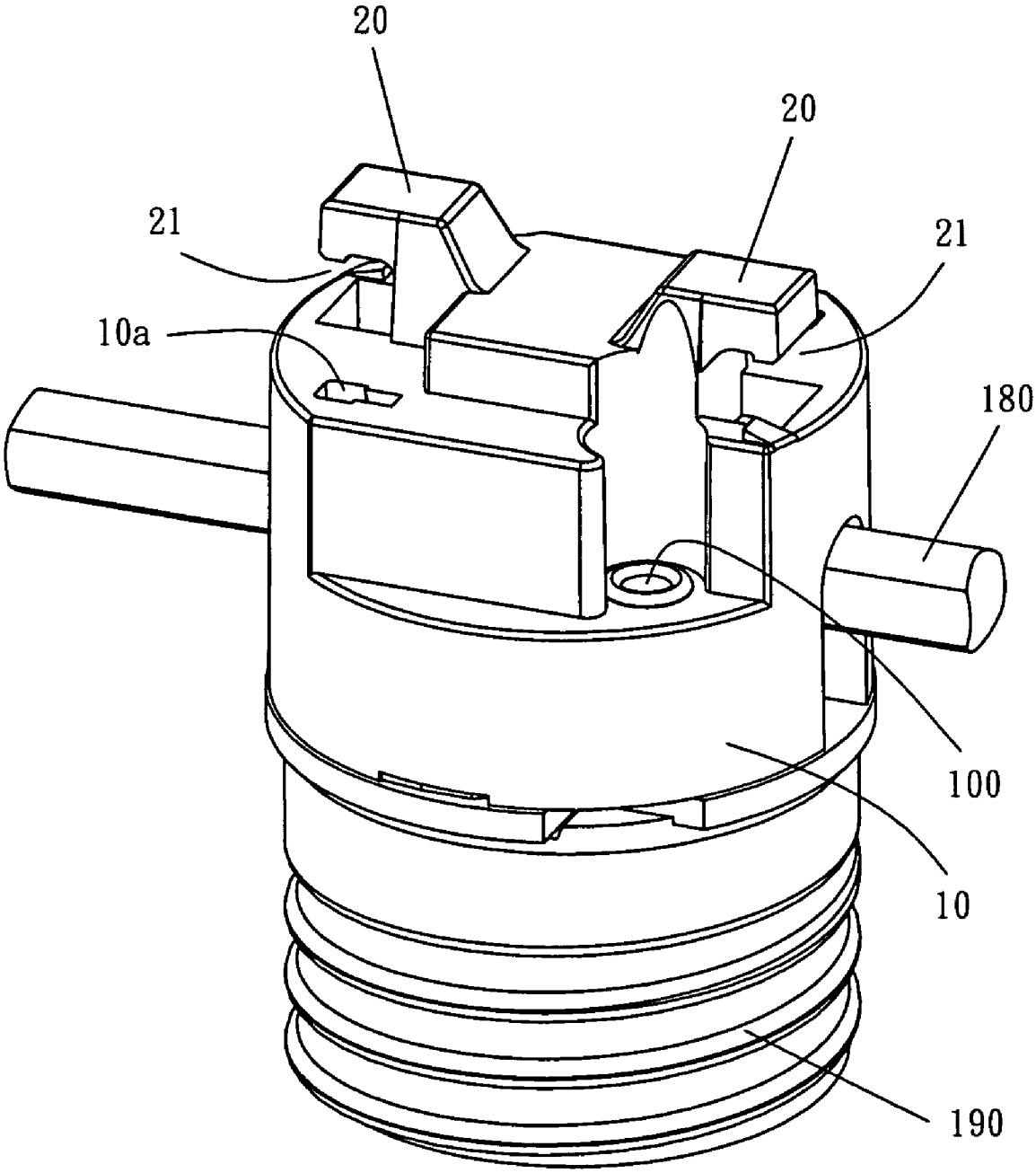
FIG. 9 is a three-dimensional view of the structural variation of the body of the exemplary embodiment of this invention.

Aside from that the appearance of the body 10 is shown in FIG. 1, it is also in FIG. 9, where its top forms a set of cord frames 20, and each is provided with a holding trough 21, where each holding trough 21 is to clip one of the two wires of the power cord, and the naked terminals of its two wires are inserted in the cord holes 10*a*, 10*b* respectively. Besides this difference, the rest of the structure is same as the aforesaid, where its description won't be repeated herewith.

In the structural combination of this invention, the assembly of the body 10, the first conducting member 130, the first contact plate 131, the second conducting member 150, the second contact plate 151, the flap 170, the push handle 180, the insulating plate 184 and the threaded tube shell 190 is a basic structure of prior push handle switch lamp holders. However, the majority portions of the structural combination of the body 10, the first contact plate 131, the second contact plate 151 and the push handle 180 are novel, which are different from the prior ones. Moreover, the extra novelty for the arrangement of the conducting plate 140 and the rectifying diode 160 enables the structural combination and the function of this invention to present great creativeness.

In conclusion, the present invention indeed accomplishes expected objective and function, and the disclosure of its structural combination has not opened to the public, which is construed to be valid for issuing a patent; however, the aforesaid exemplified embodiments of the present invention are used only for the illustration, not for the constraint of the scope; any equivalent embodiments or modifications without departing from the spirit and scope of the present invention are therefore intended to be embraced.

What is claimed is:

1. A tri-dimming push handle switch lamp holder, comprising:

1.) a body, having a through hole penetrating from top to bottom and a lodging trough set up horizontally around the center therein, where the lodging trough is provided with a first open trough and a second open trough at its both sides respectively, and the first open trough and the second open trough each being connected inward to an electric cord joint on said body;

2.) a first conducting member, L in shape, having a conducting loop at its one end, and a clip head at the other end, lodged in the first open trough, where the clip head is placed close to the electric cord joint in said body, and the conducting loop being positioned at a place higher than the body;

3.) a first contact plate, formed by bending a conductive plate, being lodged in the first open trough and being insulated separately from said first conducting member, and the one end corresponding to the lodging trough forming a position indent, lodged in the lodging trough and attached to its inner wall;

4.) a second conducting member, L in shape, having a clip head at its one end, lodged in the second open trough, where the clip head is placed close to the electric cord joint in said body;

5.) a second contact plate, formed by bending a conductive plate, being lodged in the second open trough and being connected to said second conducting member, and the one end corresponding to the lodging trough forming a position indent, lodged in the lodging trough and attached to its inner wall;

6.) a flap, having a contact point at its one end, and being connected to said first contact plate at the other end;

7.) a push handle, bar in shape, having a conducting member transversely disposed at its center, lodged in the lodging trough, and being available to be pressed that the conducting member either touching on or removing from the position indent of said first contact plate and said second contact plate;

8.) an insulating plate, covered on said body, having a hollow corresponding to the through hole and having a bore, where the conducting loop of said first conducting member corresponds with a hollow after penetrating from said insulating plate; the bore being penetrated by the contact point portion of said flap; and 9.) a threaded tube shell, made of a conductive plate and hollow cylinder in shape, and threads being formed on its inner wall, for the threaded connection with the threaded head of a light bulb, an opening being set up at the side joining said insulating plate, for the accommodation of the contact point portion of said flap, and being provided with hollows corresponding to the hollows on said insulating plate on the rest area other than the opening, to provide fasteners to penetrate the corresponding hollows and the through holes, for the joining said threaded tube shell, said insulating plate and said body together;

featuring: a first indent wall and a second indent wall being formed on both sides of the lodging trough of said body, and each being a wall made of three wavelike indents, where the first indent wall forming an insulating section at its middle wavelike indent, and the wall in between the first open trough and the first indent wall being provided with a first holding trough and a second holding trough, while the wall in between the second open trough and the second indent wall being provided with a third holding trough, and a lodging pit being set up at the side of the first open trough; said first contact plate being plugged in the first holding trough for a clipping, and the position indent corresponding to the side of the lodging trough being lodged in the lodging trough and attached to the wavelike indent at the side of the first indent wall; having a conducting plate, formed by bending a conductive plate, lodged in the first open trough and plugged in the second holding trough for a clipping, and a position indent being formed at the side corresponding to the first indent wall, being lodged in the lodging trough and attached to the wavelike indent at the side of the first indent wall; said second contact plate being plugged in the third holding trough for a clipping, and the position indent corresponding to the side of the lodging trough having three wavelike indents, attached to the three wavelike indents of the second indent wall; having a rectified diode, lodged in the lodging pit, where its positive pole connecting to the contacting plate and its negative pole to said first contact plate; said push handle having a through hole transversely disposed at its center, for the accommodation of a springy member, where its two sides each joins a arc-shaped conducting member, and the conducting member tending to move outward by means of the elasticity of the springy member, where the conducting member at one side touches one of the three indents of the position indent of said second contact plate, and the conducting member at the other side touching the position indent of said first contact plate, the insulating section and one of the three indents of the position indent of the conducting plate.

2. A tri-dimming push handle switch lamp holder as in claim 1 wherein said first conducting member is lodged in the first open trough, followed by placing an insulating chunk in the first open trough for the covering of said first conducting member, and placing said first contact plate in the first open trough, for insulating separately said first conducting member from said first contact plate through the use of the insulating chunk.

3. A tri-dimming push handle switch lamp holder as in claim 1 wherein said body is formed into a set of cord frames at its top, each having a holding trough, for the clipping of the two wires of the power cord in the holding troughs for a firm joining.

* * * * *